US010096437B2

(12) United States Patent
Watanabe

(10) Patent No.: US 10,096,437 B2
(45) Date of Patent: Oct. 9, 2018

(54) KEY SWITCH

(71) Applicants: CITIZEN ELECTRONICS CO., LTD., Yamanashi-ken (JP); CITIZEN WATCH CO., LTD., Tokyo (JP)

(72) Inventor: Masashi Watanabe, Yamanashi-ken (JP)

(73) Assignees: CITIZEN ELECTRONICS CO., LTD., Yamanashi-Ken (JP); CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 15/622,380

(22) Filed: Jun. 14, 2017

(65) Prior Publication Data

US 2017/0365422 A1 Dec. 21, 2017

(30) Foreign Application Priority Data

Jun. 19, 2016 (JP) ..... 2016-121311

(51) Int. Cl.

*H01H 13/7073* (2006.01)
*H01H 13/14* (2006.01)
*H01H 13/7065* (2006.01)
*H01H 13/50* (2006.01)

(52) U.S. Cl.

CPC ..... *H01H 13/14* (2013.01); *H01H 13/50* (2013.01); *H01H 13/7065* (2013.01); *H01H 13/7073* (2013.01); *H01H 2215/006* (2013.01)

(58) Field of Classification Search

CPC .. G06F 1/1662; H01H 13/14; H01H 13/7065; H01H 13/7073; H01H 2215/006; H01H 2221/044

USPC ..... 200/344, 345

See application file for complete search history.

(56) References Cited

U.S. PATENT DOCUMENTS 6,504,120 B2 * 1/2003 Hsu ..... H01H 3/125 200/344
6,534,736 B1 * 3/2003 Lee ..... H01H 3/125 200/344
6,706,985 B2 * 3/2004 Chun ..... H01H 13/38 200/344
8,299,382 B2 * 10/2012 Takemae ..... H01H 3/125 200/341
9,412,533 B2 * 8/2016 Hendren ..... H01H 13/14

(Continued)

FOREIGN PATENT DOCUMENTS

EP 2 040 275 3/2009
JP 2009-076321 4/2009

*Primary Examiner* — Vanessa Girardi
(74) *Attorney, Agent, or Firm* — Wenderoth, Lind & Ponack, L.L.P.

(57) ABSTRACT

A key switch includes a base plate, a key top, a pair of link members, and a switch mechanism. The key top is above the base plate. The link members support the key top and operate in an interlocked manner to allow the key top to be lifted and lowered with respect to the base plate. One of the link members includes a projecting portion at a distal end of an arm of the link member. The other one of the link members includes a concave receiving portion at a distal end of an arm of the link member. The projecting portion is rotationally fitted to the concave receiving portion. The switch mechanism is disposed between the base plate and the key top and is configured to open and close a contact portion of an electric circuit in accordance with lifting and lowering operation of the key top.

9 Claims, 9 Drawing Sheets

(56) References Cited

U.S. PATENT DOCUMENTS

| | | | | |
|---|---|---|---|---|
| 9,449,772 | B2 * | 9/2016 | Leong | H01H 13/14 |
| 9,870,880 | B2 * | 1/2018 | Zercoe | G06F 3/0202 |
| 9,916,943 | B2 * | 3/2018 | Lin | H01H 13/52 |
| 2009/0078552 | A1 | 3/2009 | Takemae et al. | |
| 2014/0116865 | A1 * | 5/2014 | Leong | H01H 13/14 200/344 |

* cited by examiner

KEY SWITCH

CROSS-REFERENCE TO RELATED APPLICATIONS

The present application claims priority under 35 U.S.C. § 119 to Japanese Patent Application No. JP2016-121311, filed Jun. 19, 2016. The contents of this application are incorporated herein by reference in their entirety.

BACKGROUND OF THE INVENTION

Field of the Invention

The present invention relates to a key switch mounted on, for example, a keyboard, or an input device of an electronic device such as personal computers.

Discussion of the Background

Key switches have been proposed that include a base plate, a key top located above the base plate, a pair of V-shaped link members, and a switch mechanism (refer to Japanese Unexamined Patent Application Publication No. 2009-76321). The pair of V-shaped link members support the key top and operate in an interlocked manner to guide the key top in a lifting and lowering direction with respect to the base plate. The switch mechanism opens and closes a contact portion of an electric circuit in accordance with lifting and lowering operation of the key top. The pair of V-shaped link members are allowed to rotate in an interlocked manner by the engagement of teeth provided at the distal end portions of the link members. The pair of link members operate in an interlocked manner to allow the key top to be lifted and lowered in an approximately vertical direction with respect to the base plate while maintaining a predetermined position. Additionally, the switch mechanism includes a dome-shaped operation member made of a rubber material. With the lowering operation of the key top, the operation member is elastically deformed to close the contact portion of the electric circuit. With the lifting operation of the key top, the operation member is restored to an upper limit position so that the contact portion of the electric circuit is opened.

According to the above-mentioned conventional key switch, the link members operate in an interlocked manner by the engagement of the teeth at the distal ends of the link members. Thus, if a dimensional variation occurs during molding of the link members, or if the engagement between the teeth is insufficient due to displacement during mounting or during operation of the link members, the engagement between the teeth may be loosened, and the link members may possibly fail to operate smoothly in an interlocked manner.

Accordingly, it is an object of the present invention to provide a key switch in which a pair of link members are smoothly rotated in an interlocked manner without being influenced by a dimensional variation caused during molding of the link members.

It is another object of the present invention to provide a key switch that is shorter in height.

SUMMARY OF THE INVENTION

A key switch according to one aspect of the present invention includes a base plate, a key top, a pair of link members, and a switch mechanism. The key top is above the base plate. The pair of link members support the key top and are configured to operate in an interlocked manner to allow the key top to be lifted and lowered with respect to the base plate. One of the pair of link members includes a projecting portion at a distal end of an arm of the link member. The other one of the pair of link members includes a concave receiving portion at a distal end of an arm of the link member. The projecting portion is rotationally fitted to the concave receiving portion. The switch mechanism is disposed between the base plate and the key top and is configured to open and close a contact portion of an electric circuit in accordance with lifting and lowering operation of the key top.

A key switch according to another aspect of the present invention includes a base plate, a key top, a pair of link members, and a switch mechanism. The key top is above the base plate. The pair of link members support the key top and are configured to operate in an interlocked manner to allow the key top to be lifted and lowered with respect to the base plate. The switch mechanism is disposed between the base plate and the key top and is configured to open and close a contact portion of an electric circuit in accordance with lifting and lowering operation of the key top. The switch mechanism includes a sheet-shaped switch member, a plate-shaped spring member, and a housing. The sheet-shaped switch member is disposed on an upper surface of the base plate and includes a contact portion of an electric circuit. The plate-shaped spring member is above the contact portion of the electric circuit. The housing is secured to the base plate and accommodates the plate-shaped spring member.

With the key switch according to one aspect of the present invention, one of the pair of link members includes the projecting portion at the distal end of the arm of the link member. The other one of the pair of link members includes the concave receiving portion at the distal end of the arm of the link member. The projecting portion is rotationally fitted to the concave receiving portion. Thus, the pair of link members are operated smoothly in an interlocked manner without backlash at the coupling portion.

The key switch according to another aspect of the present invention includes the plate-shaped spring member instead of a conventional dome-shaped operation member made of a rubber material. This configuration makes the key switch shorter in height.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
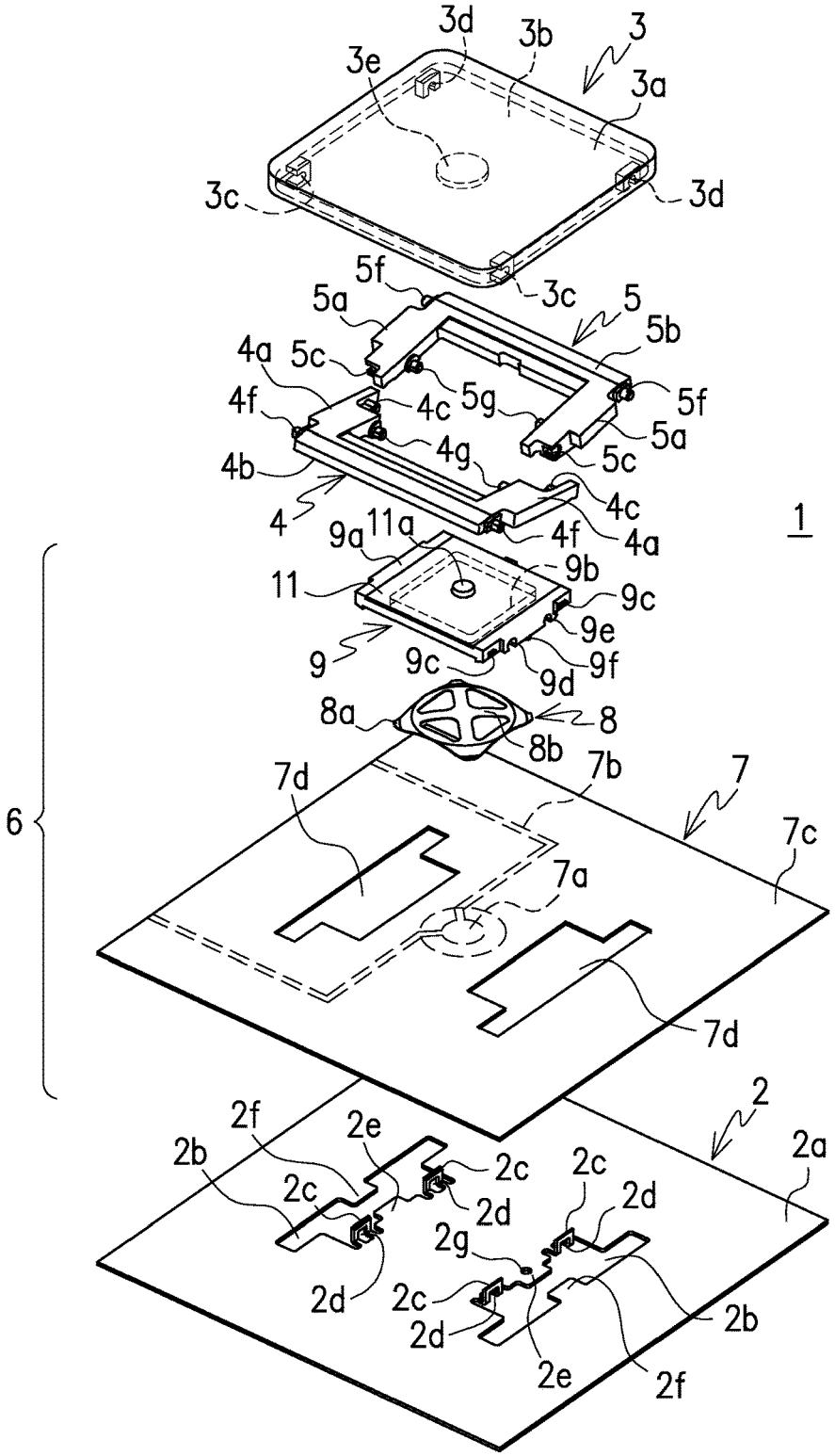
FIG. 1 is an exploded perspective view of a key switch according to a first embodiment of the present invention.

Hereinafter, a key switch according to an embodiment of the present invention will be described in detail with reference to the attached drawings. FIGS. 1 to 7D illustrate a key switch 1 according to a first embodiment of the present invention. The key switch 1 includes a rectangular base plate 2, a key top 3, a pair of link members 4 and 5, and a switch mechanism 6. The key top 3 is located above the base plate 2. The switch mechanism 6 is located between the base plate 2 and the key top 3 and opens and closes a contact portion of an electric circuit in accordance with lifting and lowering operation of the key top 3. The pair of link members 4 and 5 have an approximately identical U-shape to each other. The pair of link members 4 and 5 support the key top 3 and operate in an interlocked manner to allow the key top 3 to be lifted and lowered with respect to the base plate 2. The switch mechanism 6 is located between the base plate 2 and the key top 3, and more specifically, on an upper surface 2*a* of the base plate 2. The switch mechanism 6 includes a sheet-shaped switch member 7, a plate-shaped spring member 8, and a housing 9. The sheet-shaped switch member 7 includes a contact portion 7*a* of the electric circuit. The plate-shaped spring member 8 is located on the contact portion 7*a* of the electric circuit. The housing 9 accommodates the plate-shaped spring member 8 and is secured to the base plate 2.

The base plate 2 is made of a plastic plate or a metal plate that are rigid and tabular. The base plate 2 includes the flat upper surface 2*a*. The base plate 2 includes a pair of symmetrical open windows 2*b* provided on left and right sections along the long sides of the base plate 2. The open windows 2*b* are basically rectangular. A pair of engaging portions 2*c* are provided on the inner edge of each open window 2*b*. The pair of engaging portions 2*c* of one of the open windows 2*b* face the pair of engaging portions 2*c* of the other open window 2*b*. The engaging portions 2*c* are formed by punching and bending parts of the base plate 2 in an inverted U-shape. Each of the engaging portions 2*c* includes an engaging hole 2*d*. The engaging holes 2*d* respectively receive engaging projections 9*c*. The engaging projections 9*c* project from the outer surfaces on the left and right sides of a frame 9*a* of the housing 9. Each of the pair of open windows 2*b* also includes a rectangular inner extended portion 2*e* provided on the inner edge at a position sandwiched between the associated two engaging portions 2*c*. Each of the pair of open windows 2*b* further includes an outer extended portion 2*f* on the outer edge at a position opposing the associated inner extended portion 2*e*. One of the two inner extended portions 2*e* includes a positioning hole 2*g*. The positioning hole 2*g* is used when the housing 9 is placed on the upper surface 2*a* of the base plate 2. Additionally, as discussed below, each outer extended portion 2*f* functions as a stopper for controlling an upper limit position during lifting and lowering operation of the key top 3. That is, when the pair of link members 4 and 5 are rotated in an interlocked manner, the distal ends of at least one of the link members 4 and 5 abut against the upper surfaces of the outer extended portions 2*f* so that the rotation of the link members 4 and 5 is limited.

Figure 3:
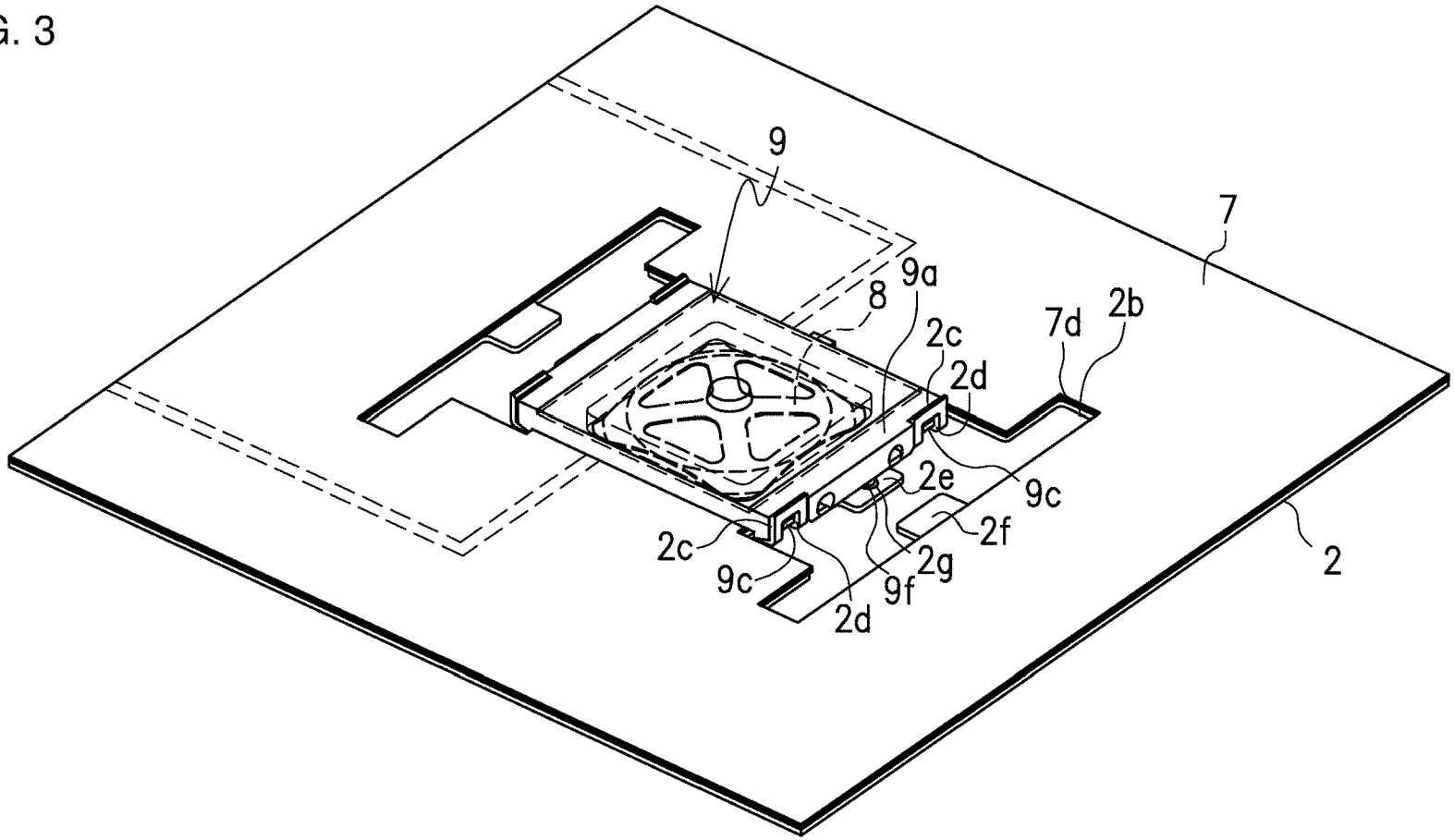
FIG. 3 is a perspective view of a base plate of the key switch according to the first embodiment of the present invention illustrating a state in which a switch mechanism is mounted on the base plate.

The sheet-shaped switch member 7 includes, for example, a membrane switch and is placed on the upper surface 2*a* of the base plate 2. The membrane switch 7 includes a flexible circuit substrate 7*c*. The flexible circuit substrate 7*c* includes a pair of opposing contacts and an electric circuit 7*b* that extends from the contacts. The contacts and the electric circuit 7*b* are formed by patterning. The contact portion 7*a* is configured such that the pair of contacts are kept in an opened state. The membrane switch 7 includes a pair of open windows 7*d*. The open windows 7*d* have approximately the same basic shape as the open windows 2*b*, which are provided on the base plate 2. As illustrated in FIG. 3, the pair of open windows 7*d* are provided at positions that approximately coincide with the pair of open windows 2*b* of the base plate 2 when the membrane switch 7 is placed on the upper surface 2*a* of the base plate 2. The engaging portions 2*c*, the inner extended portions 2*e*, and the outer extended portions 2*f*, which are provided on the base plate 2, are exposed from the pair of open windows 7*d* of the membrane switch 7.

The key top 3 is made of a plastic mold and is a square or rectangular tabular member as viewed from the top. The key top 3 includes an upper surface 3*a* that serves as a manipulation surface. The key top 3 also includes guide grooves provided on the underside of the upper surface 3*a*. The guide grooves rotationally support one edge of each of the pair of link members 4 and 5. The guide grooves are provided at positions adjacent to four corners of the inner circumferential surface of a recess 3*b* on the inner side of the key top 3. The guide grooves include a pair of horizontal guide grooves 3*c* provided at the front end corners of the recess 3*b* and a pair of vertical guide grooves 3*d* provided at the rear end corners of the recess 3*b*. The key top 3 includes a columnar projection 3*e* that slightly projects downward from the center of the recess 3*b*. The columnar projection 3*e* is formed integrally with the key top 3.

Figure 6A:
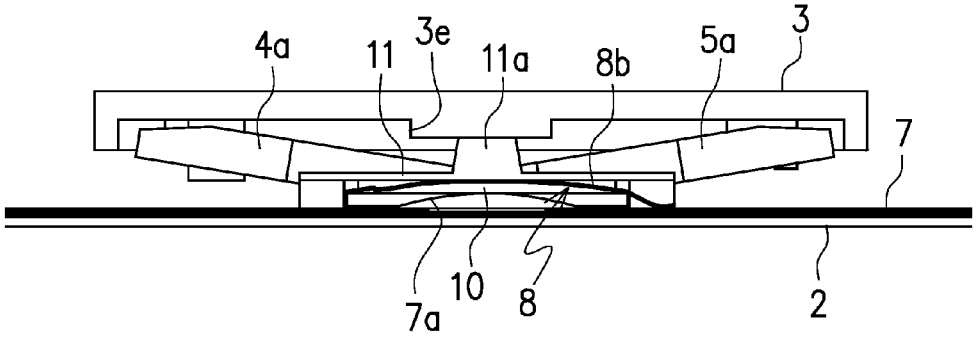
FIG. 6A is a cross-sectional view taken along the line 6A-6A of FIG. 5 when the key top is at an upper limit position.
Figure 6B:
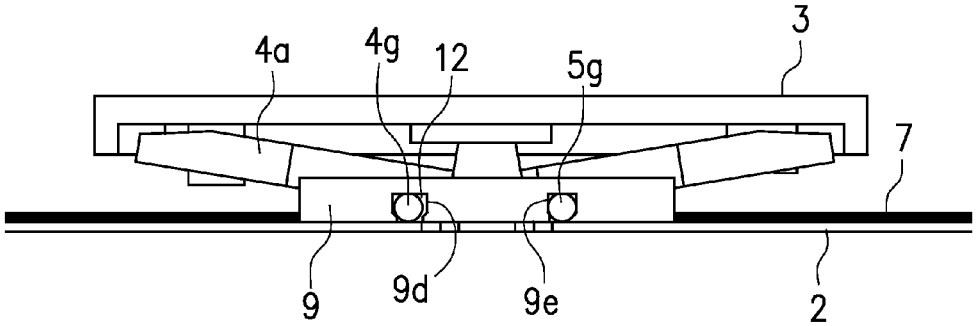
FIG. 6B is a cross-sectional view taken along the line 6B-6B of FIG. 5 when the key top is at the upper limit position.
Figure 6C:
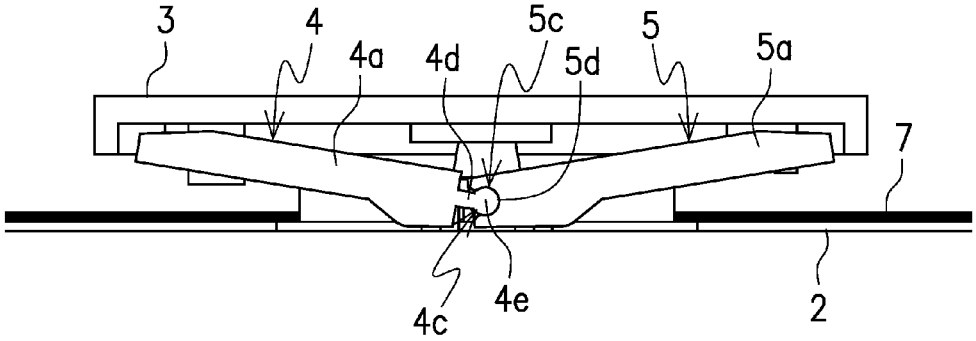
FIG. 6C is a cross-sectional view taken along the line 6C-6C of FIG. 5 when the key top is at the upper limit position.

The U-shaped link members 4 and 5 are made of plastic molds. The link member 4 includes left and right pair of arms 4*a* that extend parallel to each other in the same direction and a coupling portion 4*b* that couples the left and right pair of arms 4*a* with each other. Similarly, the link member 5 includes left and right pair of arms 5*a* that extend parallel to each other in the same direction and a coupling portion 5*b* that couples the left and right pair of arms 5*a* with each other. The pair of link members 4 and 5 are coupled by fitting the distal ends of the pair of arms 4*a* to the distal ends of the pair of arms 5*a*. The link members 4 and 5 are rotated in an interlocked manner about the above-mentioned fitting portions. More specifically, the left and right pair of arms 4*a* of the link member 4 each include a projecting portion 4*c* provided at the distal end. The left and right pair of arms 5*a* of the link member 5 each include a concave receiving portion 5*c* provided at the distal end. The projecting portions 4*c* are rotationally fitted to the concave receiving portions 5*c*. As illustrated in FIGS. 6C and 7C, each projecting portion 4*c* includes a base portion 4*d* and a columnar body 4*e* provided at the distal end of the base portion 4*d*. The diameter of the columnar body 4*e* is greater than the diameter of the base portion 4*d*. The concave receiving portion 5*c* includes a curved inner circumferential portion 5*d* that corresponds to the arc shape of the columnar body 4*e* such that the columnar body 4*e* of the projecting portion 4*c* is fitted in the concave receiving portion 5*c*. Since the projecting portions 4*c* are fitted in the concave receiving portions 5*c*, the link members 4 and 5 are more reliably coupled to each other. As a result, even if a dimensional variation occurs during molding of the link members 4 and 5, backlash is unlikely to occur when the link members 4 and 5 are fitted to each other. This configuration also allows the pair of link members 4 and 5 to smoothly rotate in an interlocked manner and the key top 3 to be smoothly lifted and lowered.

The pair of link members 4 and 5 are rotationally supported by the key top 3 and the housing 9, which will be discussed below. The left and right pair of arms 4*a* of the link member 4 each include a support pin 4*f* that projects outward from the outer surface at the rear end portion of each arm 4*a*. Similarly, the left and right pair of arms 5*a* of the link member 5 each include a support pin 5*f* that projects outward from the outer surface at the rear end portion of each arm 5*a*. The support pins 4*f* and 5*f* support the pair of link members 4 and 5 on the key top 3. The support pins 4*f*, which are provided on the link member 4, are rotationally fitted in and supported by the pair of horizontal guide grooves 3*c*, which are provided at the front end corners of the key top 3. Similarly, the support pins 5*f*, which are provided on the link member 5, are rotationally fitted in and supported by the pair of vertical guide grooves 3*d*, which are provided at the rear end corners of the key top 3.

Additionally, the left and right pair of arms 4*a* of the link member 4 each include a support pin 4*g* that projects inward from the inner surface of each arm 4*a*. Similarly, the left and right pair of arms 5*a* of the link member 5 each include a support pin 5*g* that projects inward from the inner surface of each arm 5*a*. The link members 4 and 5 are rotationally supported by the housing 9 with the support pins 4*g* and 5*g*.

Figure 2:
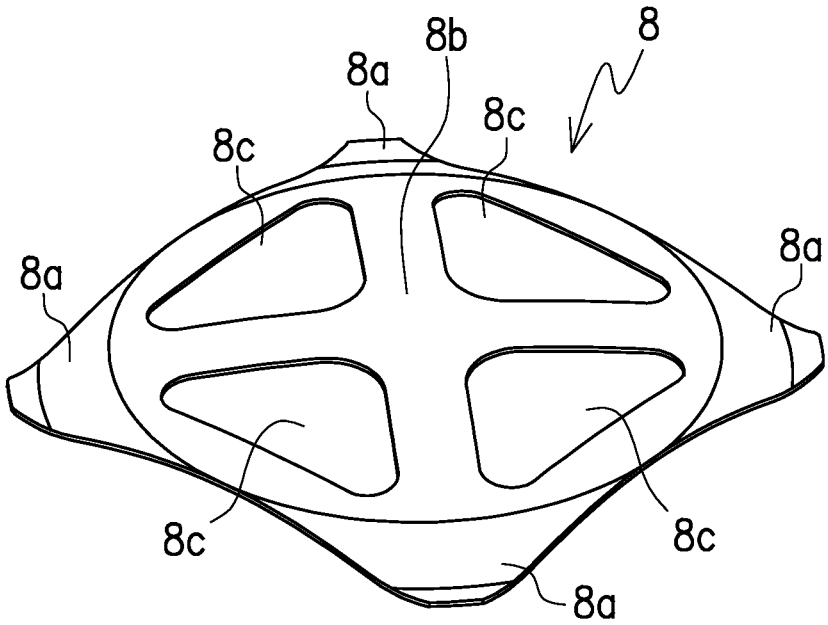
FIG. 2 is a perspective view of a plate-shaped spring member of the key switch according to the first embodiment of the present invention.

The plate-shaped spring member 8 is located on the contact portion 7*a* of the membrane switch 7. As illustrated in FIGS. 1 and 2, the plate-shaped spring member 8 is formed of a thin plate having spring characteristics into an approximately rectangular shape as a whole. The plate-shaped spring member 8 includes legs 8*a* at four corners on the outer edge. The plate-shaped spring member 8 includes a dome-shaped slightly bulging circular depression portion 8*b* at the central portion. The legs 8*a* are inclined from the depression portion 8*b* toward the distal ends. As illustrated in FIG. 6A, when the plate-shaped spring member 8 is placed, a space 10 is provided between the inner side of the depression portion 8*b* and the contact portion 7*a* of the membrane switch 7 to allow the depression portion 8*b* to be elastically deformed. Thus, the depression portion 8*b* reliably provides a tactile feeling. As illustrated in FIG. 2, the depression portion 8*b* also includes four identical holes 8*c* over approximately the entire surface in this embodiment. The four holes 8*c* are provided over the entire depression portion 8*b* so that the depression portion 8*b* is elastically deformed easily to provide a soft tactile feeling. The shape and the size of the holes 8*c* may be redesigned as required to adjust the tactile feeling obtained when the depression portion 8*b* is pressed.

The plate-shaped spring member 8 is accommodated in the housing 9, which is located above the spring member 8. The housing 9 includes the frame 9*a* integrally formed of a plastic material into a rectangular shape. The frame 9*a* defines, on the inner side, a rectangular hollow portion 9*b* that accommodates the plate-shaped spring member 8. The plate-shaped spring member 8, which is accommodated in the hollow portion 9*b*, is retained by abutting the distal ends of the four legs 8*a* against four corners of the hollow portion 9*b*. The hollow portion 9*b* of the housing 9 is covered with a sheet-shaped member 11 from above to prevent the plate-shaped spring member 8 from springing out upward. The sheet-shaped member 11 is made of a thin plastic sheet having elasticity. The outer circumferential portion of the sheet-shaped member 11 is bonded to the upper surface of the frame 9*a* of the housing 9. The sheet-shaped member 11 is capable of being elastically deformed when the sheet-shaped member 11 is pressed from above. The housing 9 further includes four engaging projections 9*c* (the engaging projections provided on the left side of the frame 9*a* are not illustrated in FIG. 1) located adjacent to the front and rear ends of the outer surfaces on the left and right sides of the frame 9*a* of the housing 9. The engaging projections 9*c* are to be respectively inserted in the engaging holes 2*d* of the engaging portions 2*c*, which are provided on the base plate 2.

The housing 9 further includes support grooves 9*d* and support grooves 9*e* at positions adjacent to the engaging projections 9*c*. The support grooves 9*d* are located close to the front ends of the left and right sides of the frame 9*a*. The support grooves 9*e* are located close to the rear ends of the left and right sides of the frame 9*a* (the support grooves provided on the left side of the frame 9*a* are not illustrated in FIG. 1). The support grooves 9*d* receive the support pins 4*g*, which are provided on the inner side of the left and right pair of arms 4*a* of the link member 4, and the support grooves 9*e* receive the support pins 5*g*, which are provided on the inner side of the left and right pair of arms 5*a* of the link member 5. The support pins 4*g* and 5*g* of the link members 4 and 5 are rotationally fitted to and supported by the support grooves 9*d* and 9*e* of the housing 9, which is secured to the base plate 2, so that the pair of link members 4 and 5 are rotational about the support pins 4*g* and 5*g*. As illustrated in FIGS. 6B and 7B, each support pin 4*g* is supported by one of the support grooves 9*d* with a gap 12 formed in between. Thus, when the pair of link members 4 and 5 are rotated, the arms 4*a* are allowed to slide in the horizontal direction.

The sheet-shaped member 11 includes a circular truncated conical projection 11*a* at the central portion of the upper surface of the sheet-shaped member 11. The circular truncated conical projection 11*a* is a short circular truncated cone and is formed integrally with the sheet-shaped member 11. The circular truncated conical projection 11*a* is located at a position corresponding to the depression portion 8*b* of the plate-shaped spring member 8. The circular truncated conical projection 11*a* is also located at a position corresponding to the columnar projection 3*e*, which is shorter in height and is provided on the inner side of the key top 3.

The key switch 1, which includes the above-described components, is produced as follows. As illustrated in FIG. 3, first, the membrane switch 7 is placed on the base plate 2 to align the open windows 7*d* of the membrane switch 7 with the open windows 2*b* of the base plate 2, and the membrane switch 7 is bonded to the base plate 2. Subsequently, the plate-shaped spring member 8 is placed on the contact portion 7*a* of the membrane switch 7, and the housing 9 is placed to cover the plate-shaped spring member 8 from above. The housing 9 is positioned by aligning a positioning pin 9*f* with the positioning hole 2*g*, which is provided on one of the inner extended portions 2*e* of the base plate 2. The positioning pin 9*f* projects from the lower surface of the frame 9*a* of the housing 9. Additionally, the engaging projections 9*c*, which are provided on the left and right sides of the frame 9*a* of the housing 9, are inserted in the engaging holes 2*d* of the engaging portions 2*c*, which are provided on the base plate 2, to be engaged so that the housing 9 is secured to the base plate 2.

Figure 4:
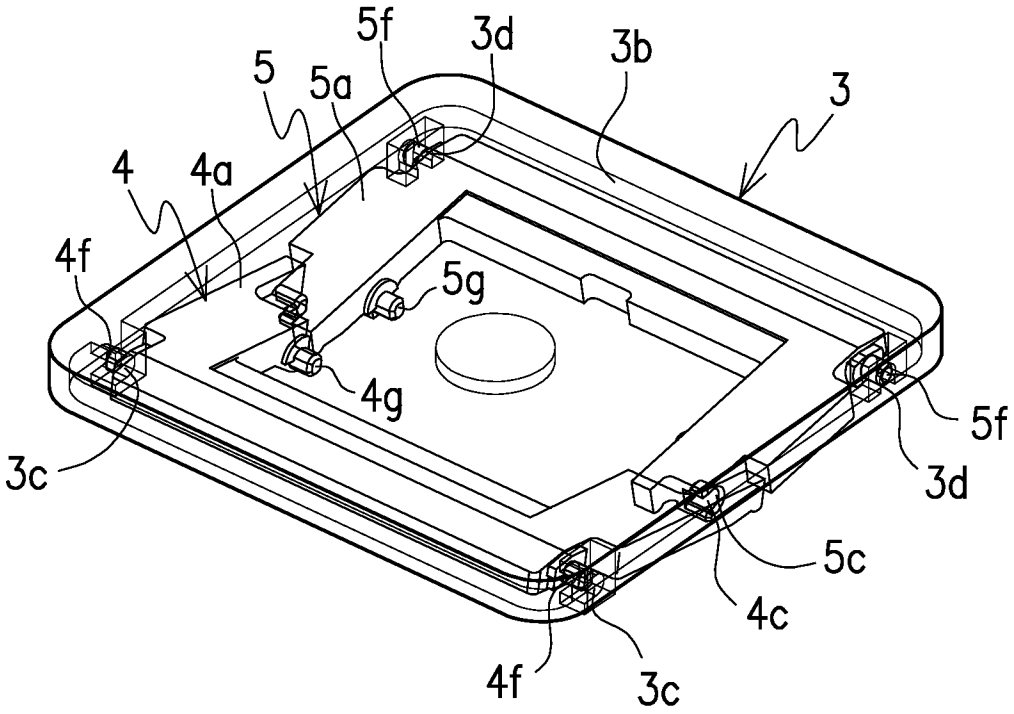
FIG. 4 is a perspective view of a pair of link members of the key switch according to the first embodiment of the present invention illustrating a state in which a key top is mounted on the pair of link members.
Figure 6D:
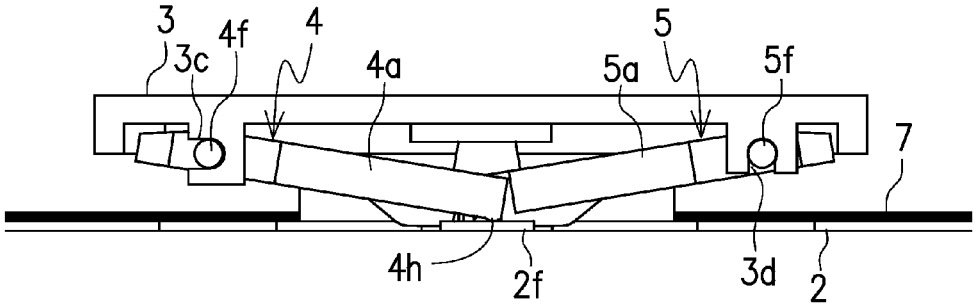
FIG. 6D is a cross-sectional view taken along the line 6D-6D of FIG. 5 when the key top is at the upper limit position.

FIG. 4 illustrates a state in which the pair of link members 4 and 5 are mounted on the key top 3. The pair of link members 4 and 5 are rotationally coupled to each other by fitting the projecting portions 4*c*, which are provided at the distal ends of the left and right pair of arms 4*a*, to the concave receiving portions 5*c*, which are provided at the distal ends of the left and right pair of arms 5*a*. The pair of link members 4 and 5 are supported by the key top 3 by fitting the support pins 4*f* and 5*f* to the horizontal guide grooves 3*c* and the vertical guide grooves 3*d*, which are provided at the four corners of the recess 3*b* of the key top 3. As illustrated in FIGS. 6D and 7D, each support pin 4*f* is supported by the associated horizontal guide groove 3*c* with a gap 13 formed in between. Thus, when the pair of link members 4 and 5 are rotated, the arms 4*a* are allowed to slide in the horizontal direction.

Figure 5:
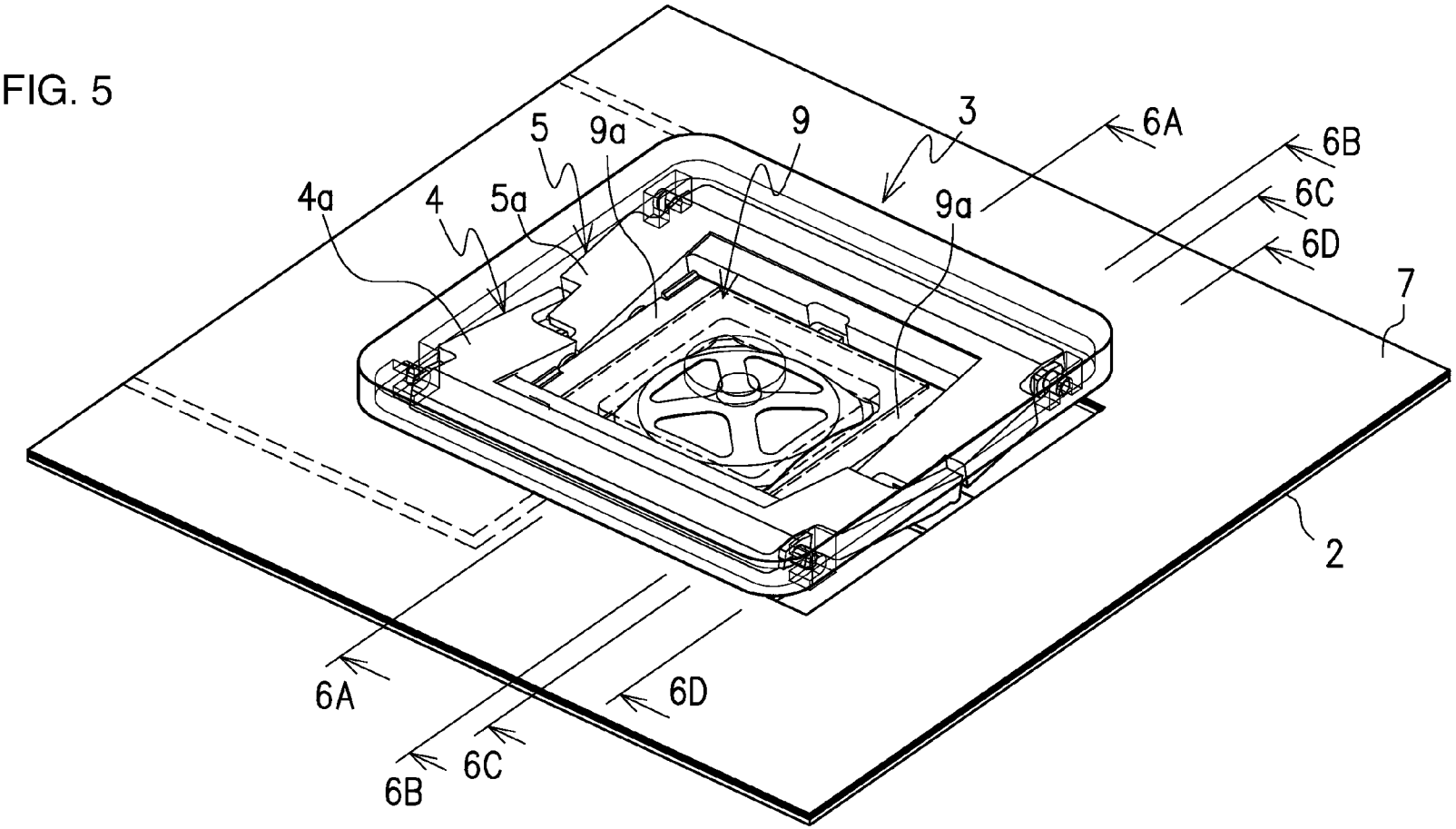
FIG. 5 is a perspective view of the key switch according to the first embodiment of the present invention.

FIG. 5 illustrates a state in which the link members 4 and 5, which are supported by the key top 3, are mounted on the base plate 2. The pair of link members 4 and 5 are placed over the housing 9 in a state in which the pair of link members 4 and 5 are mounted on the key top 3. The link member 4 is supported by the housing 9 by rotationally fitting the support pins 4*g* (refer to FIG. 4), which are provided on the inner surface of the left and right pair of arms 4*a*, to the support grooves 9*d* (refer to FIG. 1), which are provided on the left and right sides of the frame 9*a* of the housing 9. The link member 5 is supported by the housing 9 by rotationally fitting the support pins 5*g* (refer to FIG. 4), which are provided on the inner surface of the left and right pair of arms 5*a*, to the support grooves 9*e* (refer to FIG. 1), which are provided on the left and right sides of the frame 9*a* of the housing 9.

Next, operation of the key switch 1 according to the present embodiment will be described with reference to FIGS. 6A to 6D and FIGS. 7A to 7D. FIGS. 6A to 6D illustrate a state in which the key top 3 is at the upper limit position. The pair of link members 4 and 5 form a V-shape when the key top 3 is at the upper limit position of the lifting and lowering operation. As illustrated in FIG. 6A, the upper surface of the circular truncated conical projection 11*a* on the sheet-shaped member 11, which covers the upper surface of the housing 9, contacts the columnar projection 3*e* on the inner surface of the key top 3. The plate-shaped spring member 8 above the contact portion 7*a* contacts the lower surface of the sheet-shaped member 11 so that the depression portion 8*b* is retained. Thus, the contact portion 7*a* of the membrane switch 7 is in an opened state. Furthermore, as illustrated in FIG. 6D, distal end portions 4*h* of the arms 4*a* of the link member 4 abut against the outer extended portions 2*f* of the open windows 2*b* of the base plate 2. This configuration controls the upper limit position of the lifting and lowering operation of the key top 3.

As illustrated in FIGS. 6C and 7C, the pair of link members 4 and 5 are rotated in an interlocked manner by fitting the projecting portions 4*c*, which are provided at the distal ends of the arms 4*a*, to the concave receiving portions 5*c*, which are provided at the distal ends of the arms 5*a*. Additionally, as illustrated in FIGS. 6D and 7D, the support pins 4*f*, which are provided at the rear ends of the arms 4*a*, are rotationally supported by the horizontal guide grooves 3*c* of the key top 3. Similarly, the support pins 5*f*, which are provided at the rear ends of the arms 5*a*, are rotationally supported by the vertical guide grooves 3*d* of the key top 3. Furthermore, as illustrated in FIGS. 6B and 7B, the support pins 4*g*, which are provided at the front ends of the arms 4*a*, are rotationally supported by the support grooves 9*d* of the housing 9. Similarly, the support pins 5*g*, which are provided at the front ends of the arms 5*a*, are rotationally supported by the support grooves 9*e* of the housing 9. Since the support pins 4*f* and 4*g* are supported in a state in which the gaps 13 and 12 are respectively provided in the horizontal guide grooves 3*c* and the support grooves 9*d*, when the pair of link members 4 and 5 are rotated, the link member 4 is allowed to slide in the horizontal direction in the gaps 13 and 12. Thus, the pair of link members 4 and 5 are smoothly operated in an interlocked manner.

Figure 7A:
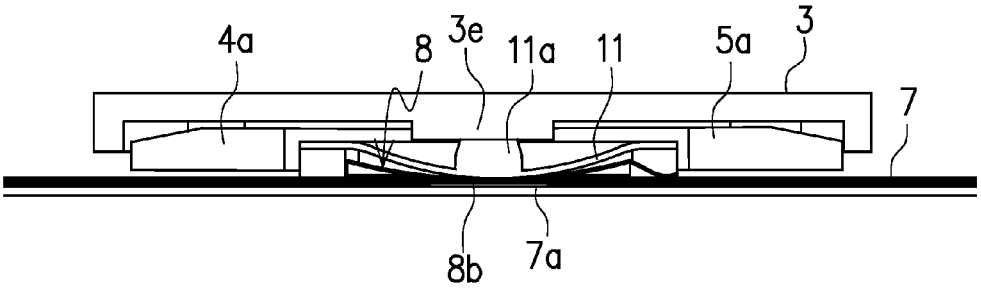
FIG. 7A is a cross-sectional view taken along the line 6A-6A of FIG. 5 when the key top is at a lower limit position.
Figure 7B:
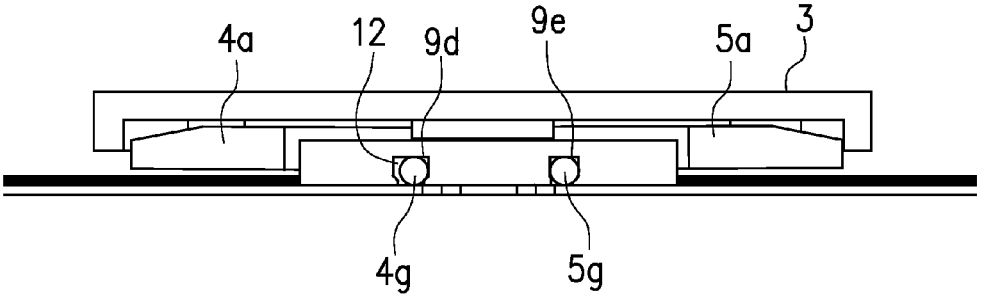
FIG. 7B is a cross-sectional view taken along the line 6B-6B of FIG. 5 when the key top is at the lower limit position.
Figure 7C:
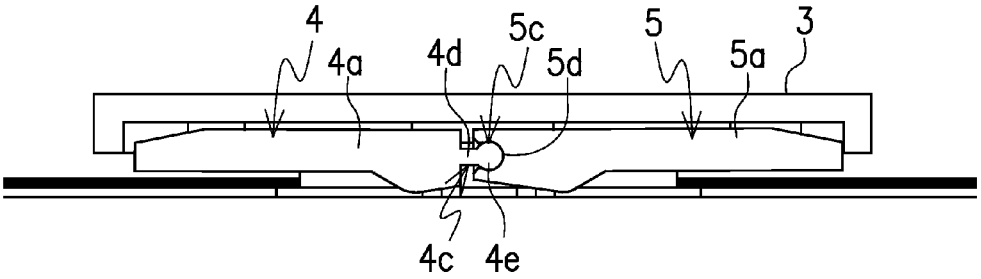
FIG. 7C is a cross-sectional view taken along the line 6C-6C of FIG. 5 when the key top is at the lower limit position.
Figure 7D:
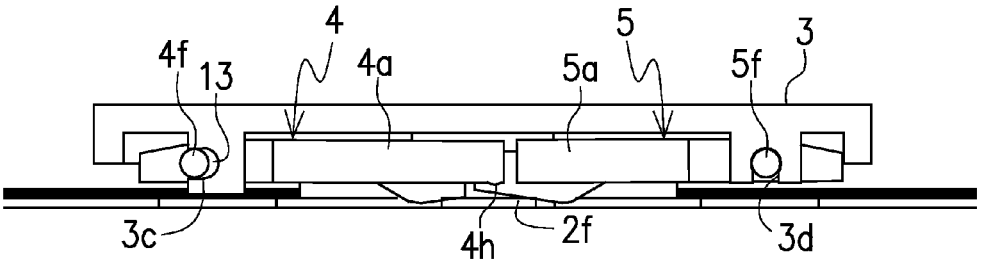
FIG. 7D is a cross-sectional view taken along the line 6D-6D of FIG. 5 when the key top is at the lower limit position.

FIGS. 7A to 7D illustrate a state in which the key top 3 is at a lower limit position of the lifting and lowering operation. When the key top 3 is depressed, the pair of link members 4 and 5 are rotated in an interlocked manner such that the shape of the pair of link members 4 and 5 changes from a V-shape to a flat shape. The rotation of the link members 4 and 5 lowers the key top 3. As illustrated in FIG. 7A, the columnar projection 3*e* presses the circular truncated conical projection 11*a* and deforms the sheet-shaped member 11 downward to press the plate-shaped spring member 8 downward. The depression portion 8*b* of the pressed plate-shaped spring member 8 is elastically deformed to curve, and the plate-shaped spring member 8 contacts the contact portion 7*a* of the membrane switch 7 so that the contact portion 7*a* is closed. When a finger is removed from the upper surface of the key top 3, depression is released, and the plate-shaped spring member 8 pushes the sheet-shaped member 11 upward by the elastic restoration force of the plate-shaped spring member 8. At this time, the plate-shaped spring member 8 pushes the key top 3 upward via the circular truncated conical projection 11*a* and the columnar projection 3*e*. Accordingly, the pair of link members 4 and 5 move in an interlocked manner to form a V-shape again. The upper limit position of the key top 3 is controlled by the stoppers as described above.

Figure 8:
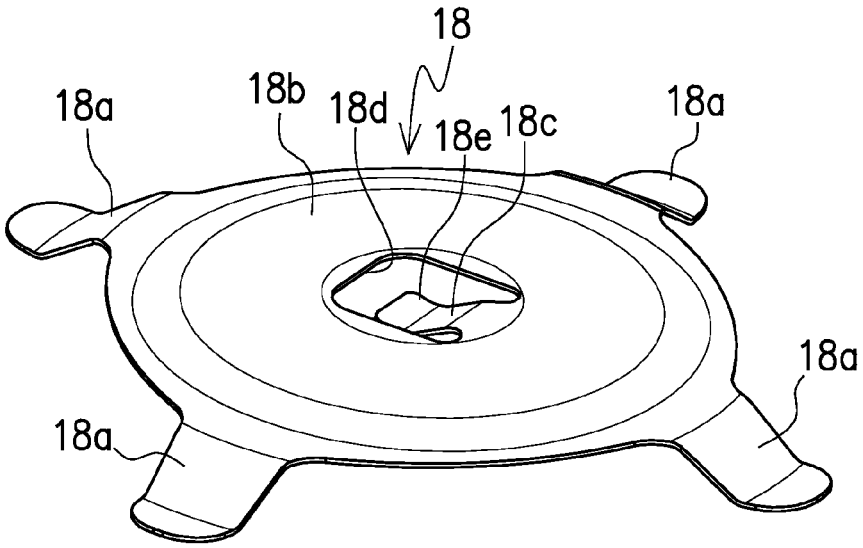
FIG. 8 is a perspective view of a plate-shaped spring member of a key switch according to a second embodiment of the present invention.
Figure 9:
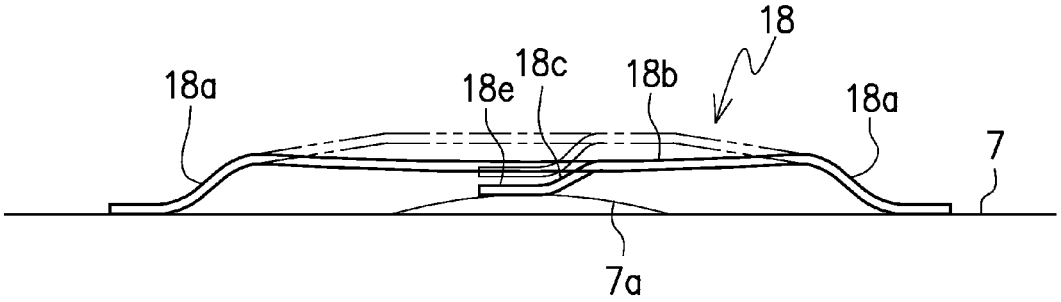
FIG. 9 is a cross-sectional view of the plate-shaped spring member of the key switch according to the second embodiment of the present invention illustrating a state in which the plate-shaped spring member is elastically deformed.

FIGS. 8 and 9 illustrate a plate-shaped spring member 18 according to a second embodiment. The plate-shaped spring member 18 according to this embodiment includes a disk-shaped depression portion 18*b* and four legs 18*a* at the periphery of the depression portion 18*b*. The depression portion 18*b* includes a depression piece 18*c* that is pressed to contact with the contact portion 7*a* of the membrane switch 7. The depression piece 18*c* is formed of a punched and bent piece that is formed by punching and bending the central portion of the depression portion 18*b*. The depression portion 18*b* includes a rectangular punched hole 18*d* at the central portion of the depression portion 18*b*. The punched hole 18*d* is provided by forming a slit in the depression portion 18*b* in a U-shape. The edge portion of the punched hole 18*d* without the slit is coupled to the depression portion 18*b*. The punched and bent piece is formed by bending the edge portion of the punched hole 18*d* toward the lower surface of the depression portion 18*b*. The depression piece 18*c* includes a flat portion 18*e* at the distal end portion. In the plate-shaped spring member 18, the depression piece 18*c* is elastically deformed in addition to the depression portion 18*b*, and the flat portion 18*e* of the depression piece 18*c* directly presses the contact portion 7*a* of the membrane switch 7. Thus, in the plate-shaped spring member 18, firstly, the depression portion 18*b* is elastically deformed, and by a further application of pressure, the depression piece 18*c* is elastically deformed to press the contact portion 7*a*. Thus, the contact portion 7*a* of the membrane switch 7 is pressed in two stages. This provides a softer tactile feeling.

Obviously, numerous modifications and variations of the present invention are possible in light of the above teachings. It is therefore to be understood that within the scope of the appended claims, the present invention may be practiced otherwise than as specifically described herein.

What is claimed is:

1. A key switch comprising:

a base plate;

a key top above the base plate;

a pair of link members supporting the key top and configured to operate in an interlocked manner to allow the key top to be lifted and lowered with respect to the base plate; and a switch mechanism disposed between the base plate and the key top and configured to open and close a contact portion of an electric circuit in accordance with lifting and lowering operation of the key top, the switch mechanism comprising:

a sheet-shaped switch member disposed on an upper surface of the base plate and comprising a contact portion of an electric circuit;

a plate-shaped spring member above the contact portion of the electric circuit; and a housing secured to the base plate and accommodating the plate-shaped spring member.

2. The key switch according to claim 1, wherein each of the pair of link members comprises an arm comprising a distal end section rotationally supported by the housing, wherein each link member comprises a rear end section supported by the key top, and wherein, when the key top is at an upper limit position of lifting and lowering operation, the pair of link members are configured to form a V-shape.

3. The key switch according to claim 1, wherein the plate-shaped spring member comprises a depression portion comprising a hole and configured to be elastically deformed.

4. The key switch according to claim 1, wherein the base plate comprises a stopper configured to control an upper limit position during lifting and lowering operation of the key top, and when the pair of link members are rotated, a distal end of at least one of the link members is configured to abut against the stopper.

5. The key switch according to claim 1, wherein the housing comprises a frame comprising a recess accommodating the plate-shaped spring member, and a sheet-shaped member comprising an upper surface comprising a projection at a position corresponding to a depression portion of the plate-shaped spring member, the sheet-shaped member covering the recess of the frame.

6. The key switch according to claim 1, wherein one of the pair of link members comprises a projecting portion at a distal end of an arm of the link member, the other one of the pair of link members comprises a concave receiving portion at a distal end of an arm of the link member, and the projecting portion is rotationally fitted to the concave receiving portion.

7. The key switch according to claim 6, wherein the projecting portion on one of the link members comprises a columnar portion at a distal end, and wherein the concave receiving portion on the other one of the link members comprises a curved inner circumferential portion corresponding to an arc shape of the columnar portion.

8. The key switch according to claim 1, wherein the plate-shaped spring member comprises a depression portion configured to be elastically deformed, and a depression piece disposed at a part of the depression portion and configured to press the contact portion of the electric circuit.

9. The key switch according to claim 8, wherein the depression piece comprises a punched and bent piece at a central portion of the depression portion.

* * * * *